US006394911B1

(12) United States Patent
Vaughn

(10) Patent No.: US 6,394,911 B1
(45) Date of Patent: May 28, 2002

(54) PENDULUM-TYPE GOLF PUTTER

(76) Inventor: Phillip L. Vaughn, 5513 Belnap, NW., Albuquerque, NM (US) 87114

( * ) Notice: Subject to any disclaimer, the term of this patent is extended or adjusted under 35 U.S.C. 154(b) by 0 days.

(21) Appl. No.: 09/715,554

(22) Filed: Nov. 16, 2000

(51) Int. Cl.[7] ..... A63B 53/14
(52) U.S. Cl. ..... 473/294; 473/295
(58) Field of Search ..... 473/293, 294, 473/295, 313, 340, 341; D21/736

(56) References Cited

U.S. PATENT DOCUMENTS 1,919,221 A * 7/1933 Janes
2,204,974 A * 6/1940 Strasser
4,215,860 A * 8/1980 Nakamatsu
5,209,475 A * 5/1993 Loman
5,672,117 A * 9/1997 Dar
5,746,662 A * 5/1998 Squire

* cited by examiner

*Primary Examiner*—Stephen Blau
(74) *Attorney, Agent, or Firm*—Allen D. Brufsky

(57) ABSTRACT

A pendulum type putter includes a U-shaped, yoke-like handle, connected at an angle to the club shaft. The yoke includes a rotatable mandrel pivotable at opposed ends between the legs of the U-shaped yoke, while the bight of the yoke has an adapter for connection to the club shaft. The yoke legs, bight and club shaft are swung in pendulum like fashion by gripping the shaft and mandrel and swinging the shaft with a pendulum-like motion relative to the mandrel. The use of the yoke alleviates any interference with the pendulum movement of the shaft by the grip of the user. Further, the mechanical advantage gained by spacing the shaft adapter at an angle from the mandrel makes it easier to swing the club with less force.

5 Claims, 6 Drawing Sheets

PENDULUM-TYPE GOLF PUTTER

TECHNICAL FIELD

The present invention relates generally to golf putters, and relates more specifically to an improved pendulum-type golf putter.

BACKGROUND OF THE INVENTION

Many golfers believe that swinging the golf putter with a pendulum action provides a motion that leads to consistency and accuracy in putting. It is believed that if the ball is struck squarely with the putter head, it will follow a line defined by the path that the putter has taken during the backswing and follow through. Accordingly, modifications have been made to golf putters to improve or enhance a pendulum-like motion, and to encourage that the backswing and follow-through be in perfect alignment with the hole. U.S. Pat. No. 5,127,650 to Schneller; U.S. Pat. No. 5,125,657 to Beil; U.S. Pat. No. Des 0425,951 to Davis; U.S. Pat. No. 5,868,631 to Paloneu; U.S. Pat. No. 3,874,668 to Flege; and U.S. Pat. No. 5,188,361 to Coombe all describe pendulum-type golf putters.

U.S. Pat. No. 5,474,300 to Scalise et al. describes a putter for use in training a golfer in a style of putting in which a crossrod at the upper end of the club shaft is provided with a sleeve supported at each end by ball bearings. The crossrod is mounted to the club shaft at a right angle, but the putter head is affixed to the shaft at an angle.

However, putters constructed in accordance with this patent have certain shortcomings. With a Scalise putter, a golfer maintains a firm grip on the sleeve with one hand during the backswing and attempts a pendulum-like stroke by using the other hand to grip and twist a portion of the crossrod that extends out away from the golfer in order to raise the club head to a desired height during the backswing. This putter forces the user to twist the crossbar in order to raise the shaft of the putter, causing undesirable torque on the wrist. Furthermore, a player must hold the handle at a slight incline to keep the club head swinging on a level plane, which makes a consistent pendulum action more difficult.

U.S. Pat. No. 4,252,317 to Vezina describes a putter comprised of a lower shaft and an upper shaft, both shafts being rotatable with respect to one another. The putter has a bilaterally symmetrical head which enables conversion of a right-handed putter into a left handed putter and vice versa, U.S. Pat. No. 5,746,662 to Squire describes a pendulum-type putter having three handles; one on the shaft to control the swing, one horizontal handle to grip the putter and the third, in line with the second to position and stabilize the putter against the user's body. The putter shaft is pivoted between the second and third handles by the provision of an adapter connected to a rotatable shaft between the second and third handles. If the gripping hand contacts and overlies the adapter, there can easily be resistance to the pendulum swing.

SUMMARY OF THE INVENTION

In the present invention, a U-shaped yoke-like handle is connected at an angle to the club shaft. The yoke includes a rotatable mandrel pivotal at opposed ends to between the legs of the U-shaped yoke, while the bight of the yoke has an adapter for connection to the club shaft. The yoke legs, bight and club shaft are swung in pendulum like fashion by gripping the shaft and mandrel and swinging the shaft with a pendulum-like motion relative to the mandrel. The use of the yoke alleviates any interference with the swing of the pendulum shaft of putter club by spacing the rotatable, mandrel from the shaft adapter so as to preclude interference with the pendulum movement of the shaft by the grip of the user. Further, the mechanical advantage gained by spacing the shaft adapter at an angle from the mandrel makes it easier to swing the club with less force.

BRIEF DESCRIPTION OF THE DRAWING

Further objects and advantages of the invention will become more apparent from the following description and claims, and from the accompanying drawings, wherein:

DETAILED DESCRIPTION OF THE PREFERRED EMBODIMENT

Figure 1:
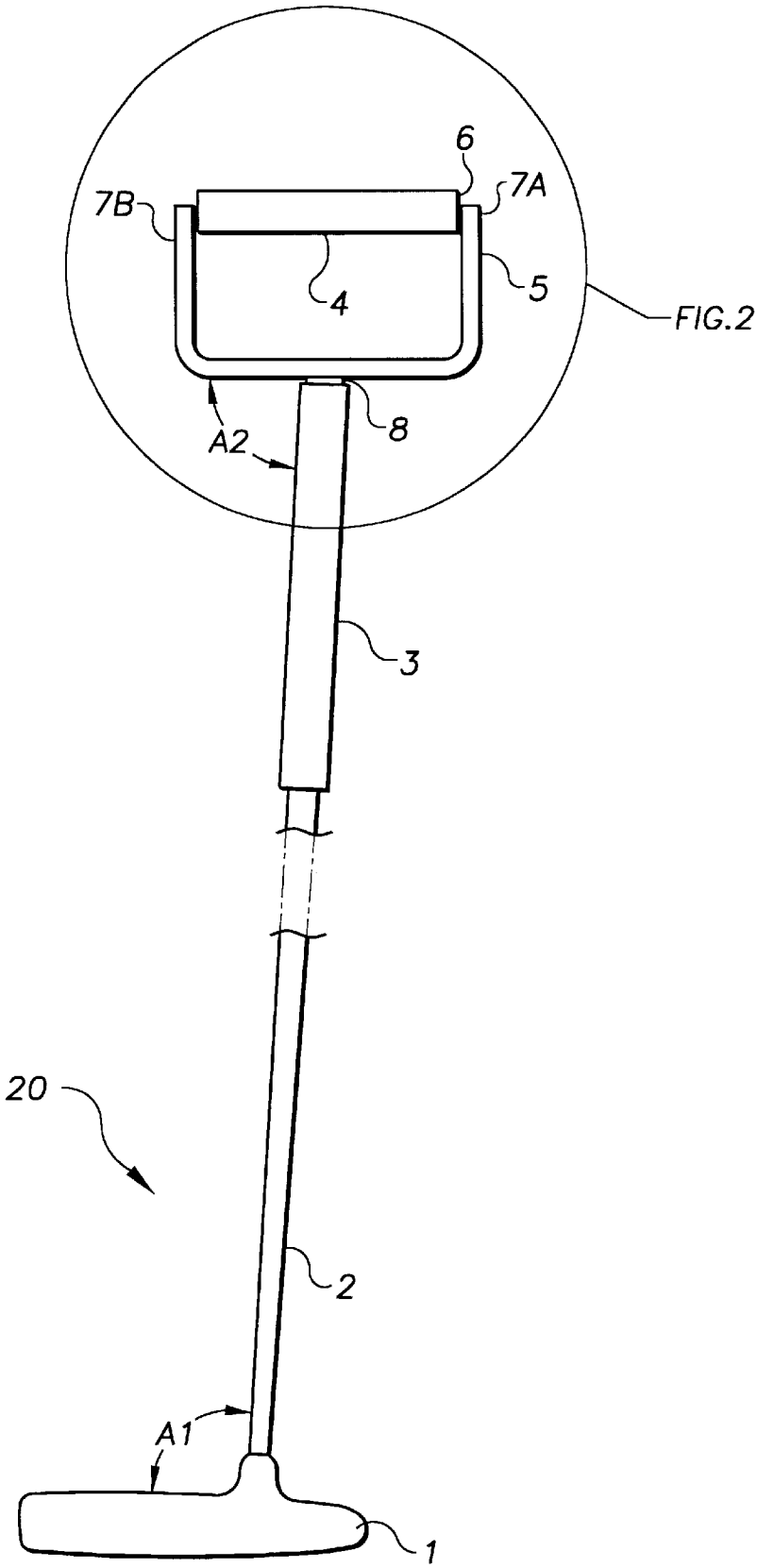
FIG. 1 is a front view in elevation of the putter of the present invention.
Figure 3:
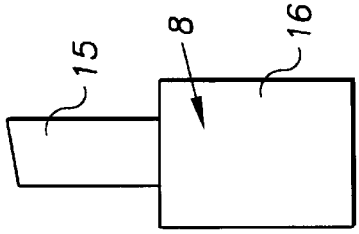
FIG. 3 is a front view in elevation of the shaft adapter illustrated in FIG. 2 connected to the bight of the yoke portion of the putter of FIG. 2.
Figure 3A:
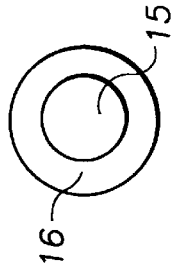
FIG. 3A is a top view in elevation of the shaft adapter of FIG. 3.
Figure 2:
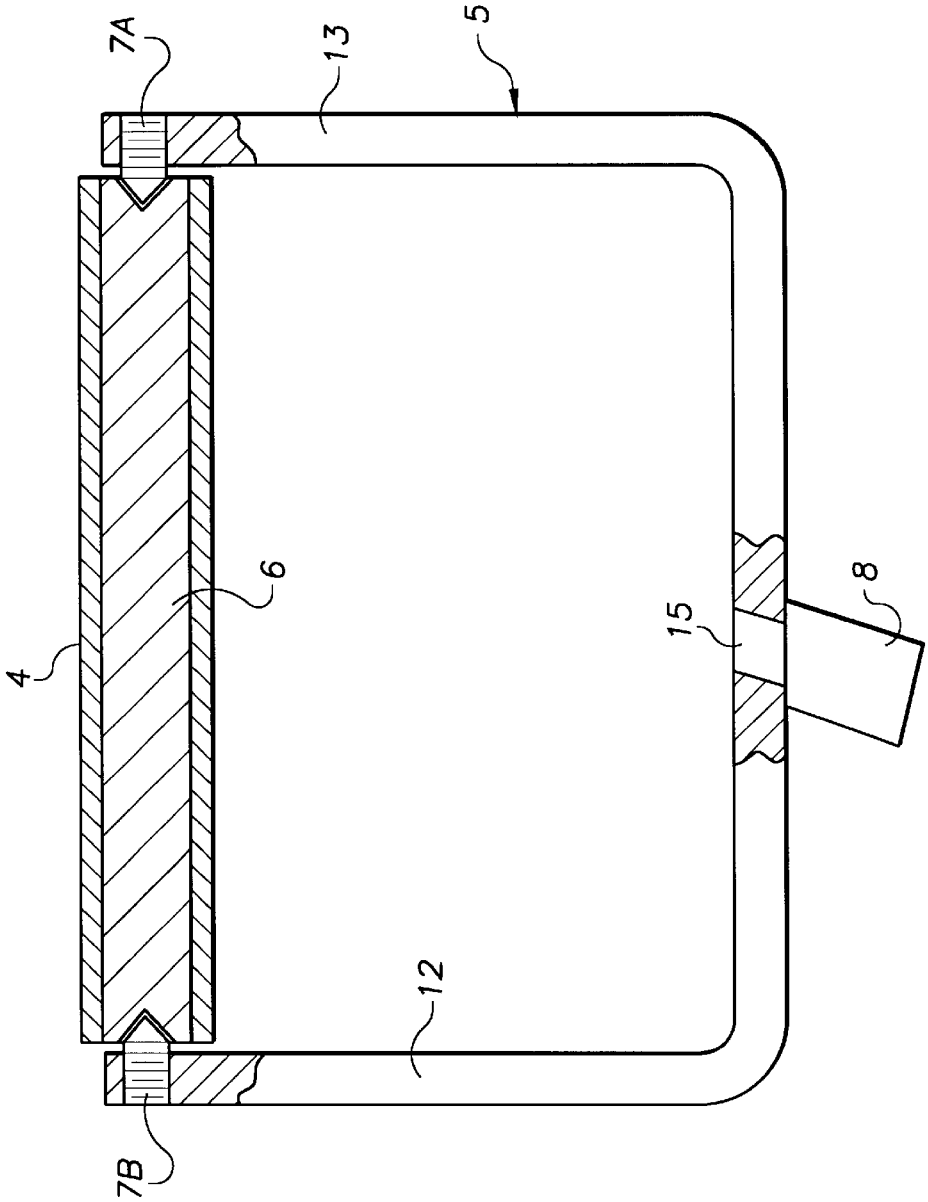
FIG. 2 is a front view in elevation of the upper yoke portion of the putter of FIG. 1 and in particular the portion encircled as detail A.
Figure 4:
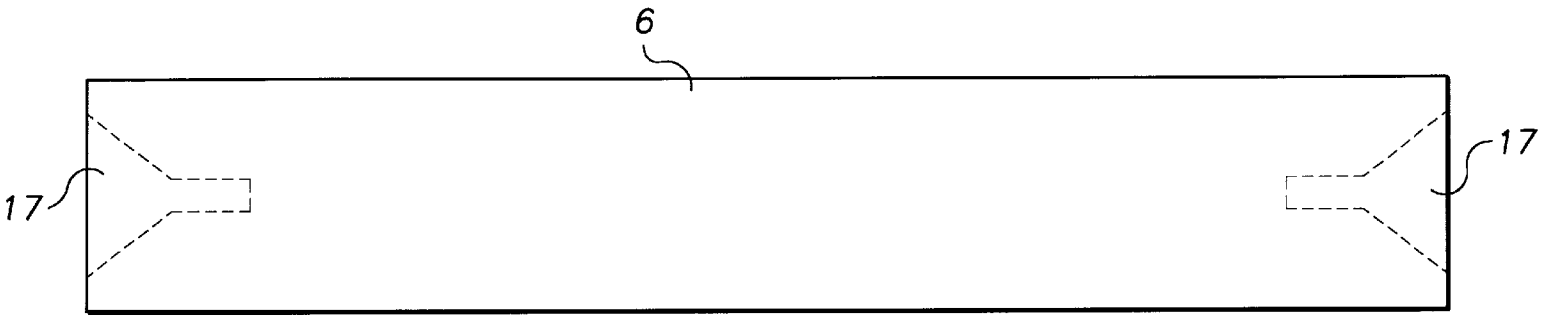
FIG. 4 is a front view in elevation of the rotating mandrel connected to the legs of the yoke portion of the putter illustrated in FIG. 2.
Figure 4A:
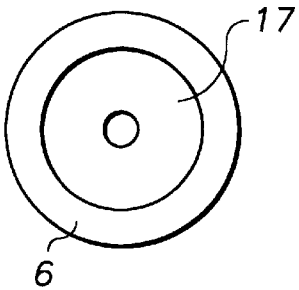
FIG. 4A is a side view in elevation of the mandrel of FIG. 4 as seen from the right hand side of FIG. 4.

Referring now to the drawings in detail, wherein like numerals indicate like elements throughout the several views, the putter 20 includes a club head 1, an elongated main shaft 2 extending upwardly from the club head, and a yoke 5 with a rotating mandrel 6 affixed between the two yoke uprights 12, 13, on both ends with cone head set screws 7A, 7B. The rotating mandrel 6 is covered with a rubber-like or leather grip 4. The yoke 5 is aligned with, and parallel to, the putter head 1.

The user G grips the rotating mandrel 6 (see FIG. 7) to support the club 20 and control axial movement of the club. With another hand, the user G holds the lower grip 3 on the top of shaft 2 and rotates the putter 20 along the mandrel axis, creating a pendulum motion.

The advantages of the putter are:

Improved balance as a result of the rotating mandrel being supported on both ends.

Swing control along the main shaft is improved because of the mechanical advantage offered by the yoke style handle.

The pendulum action is smooth and consistent due to the rotating mandrel supported by the core head set screws.

Because of its simple design and construction, these units can be made available at a modest price, allowing access by all golfers.

Construction of the putter is the same as traditional construction with the addition of a yoke style handle and shaft adapter.

Figure 5B:
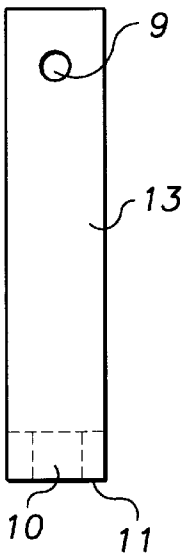
FIG. 5B is a side view in elevation of the yoke of FIG. 5, as seen from the right hand side of FIG. 5.
Figure 5:
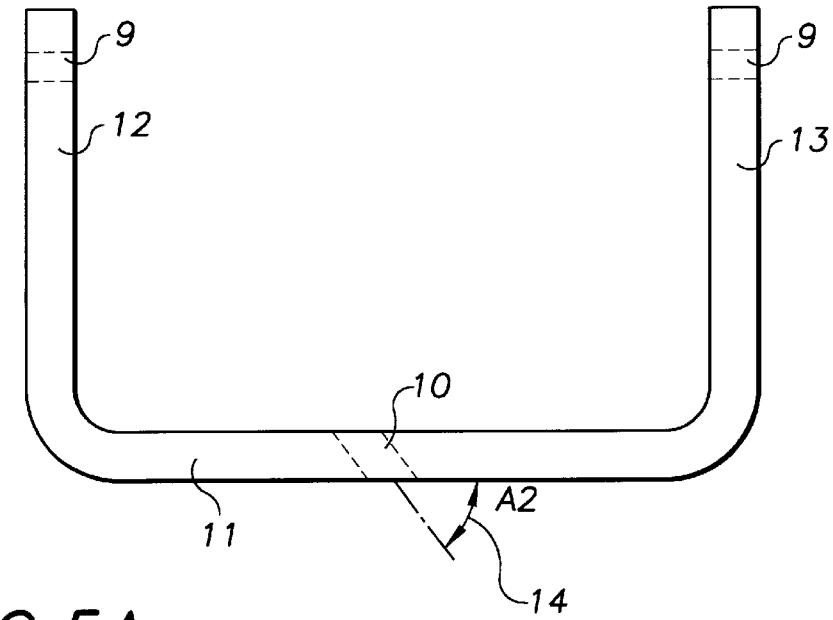
FIG. 5 is a front view in elevation of the yoke portion of the putter.
Figure 5A:
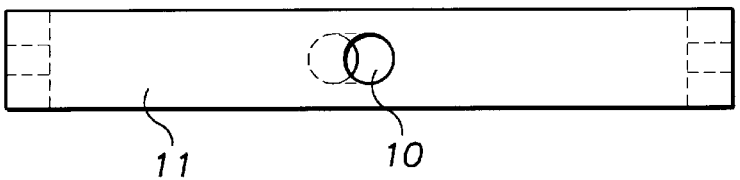
FIG. 5A is a bottom plan view of the putter yoke shown in FIG. 5.
Figure 6:
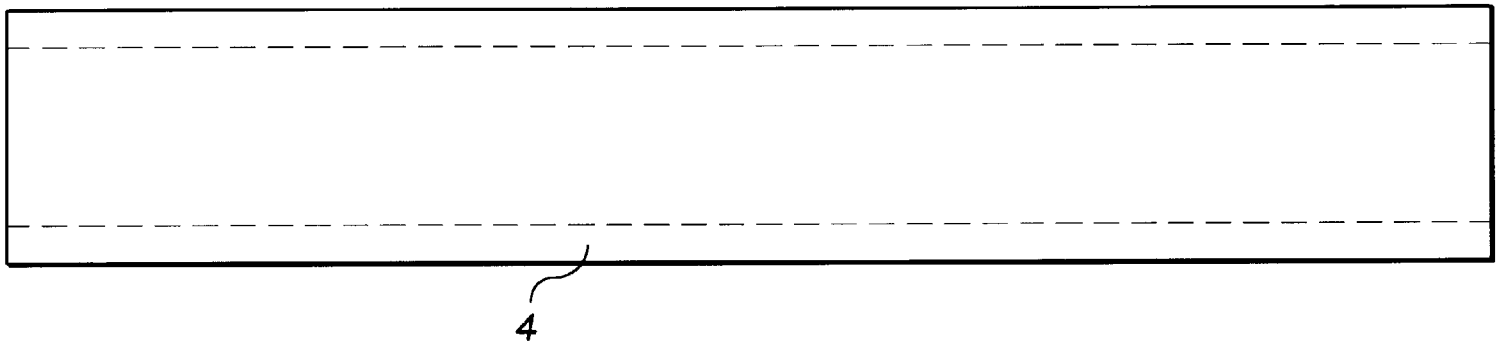
FIG. 6 is a front view in elevation of the rotatable grip on the mandrel pivotably mounted on the yoke.
Figure 6A:
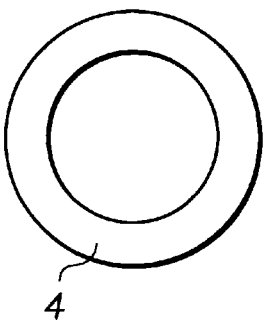
FIG. 6A is a side view in elevation of the of the grip of FIG. 6, as seen from the right hand side of FIG. 6.

The yoke 5 is formed using flat aluminum stock with a threaded hole 9 in each of the uprights 12 and 13 (see FIG. 5). A through hole 10 is bored in the center of the cross bar part 11 of the yoke 5 at a predetermined acute angle 14, to receive an upright stem 15 of a shaft adapter 8 extending at an angle to the center line of the cylindrical base 16 of the adapter, which is pressed and glued into the hole 10. The base 16 of the shaft adapter 8 is then pressed and glued into the top of the shaft 2 of the putter 20, which can have a leather grip 3 wrapped about the upper end. The solid cylindrical rotating mandrel 6 is then covered with an upper leather grip 4. Two set screws 7A, 7B are screwed into opposite sides of the uprights 13,12, respectively of the yoke 5 suspending the rotating mandrel 6 for rotation about the pointed heads of the setscrews 7A, 7B received in conically-shaped slots in the mandrel end faces.

Figure 7:
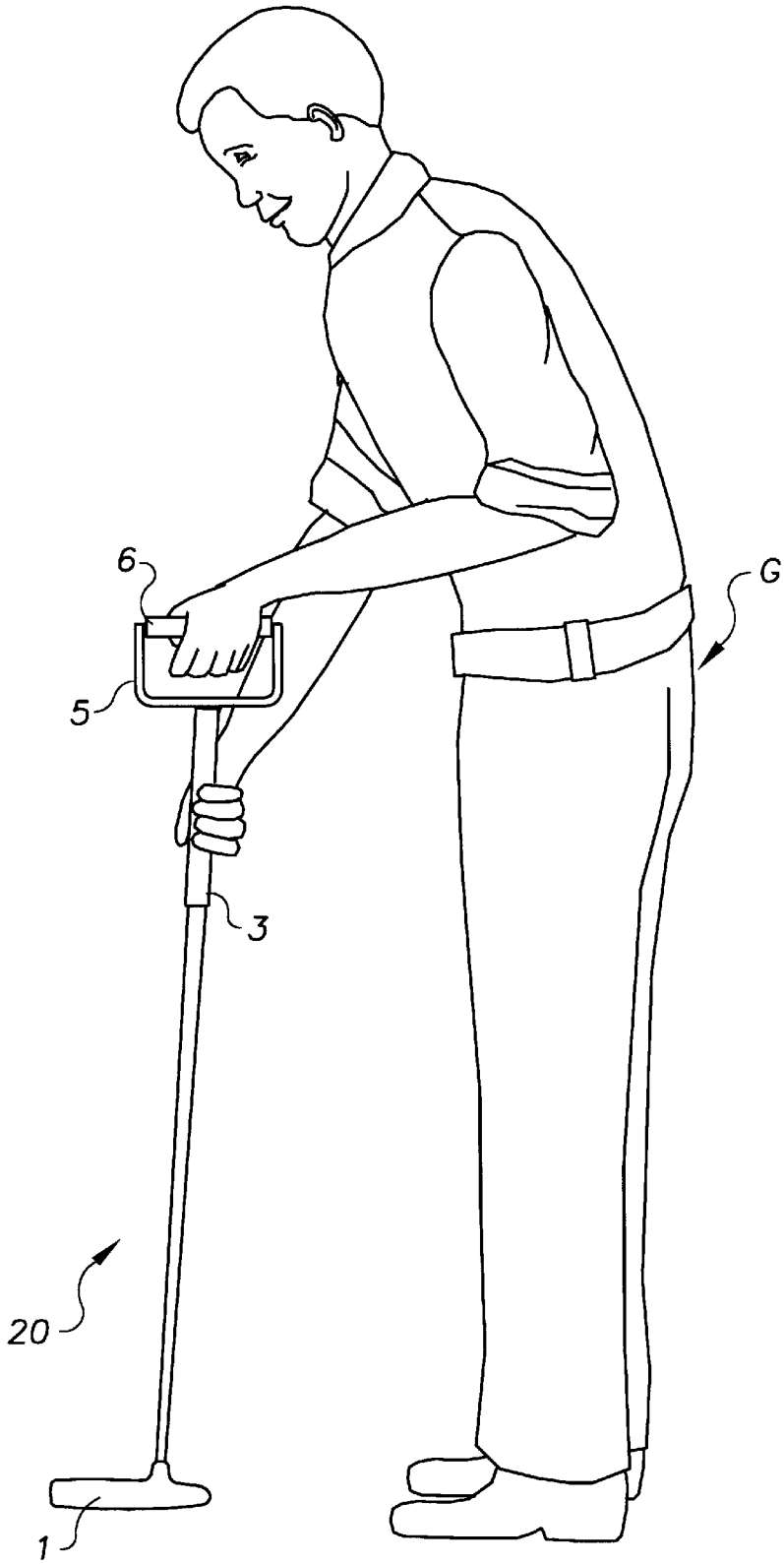
FIG. 7 illustrates a golfer using the putter of the present invention.

As illustrated in FIG. 7, a golfer G can grasp the leather grip 4 of the mandrel 6 in one hand and the leather grip 3 on shaft 2 with the other, swinging the club head 1 and shaft 2 in an arc along with yoke 5 relative to the mandrel 6. The putter head 1 remains parallel to the putting surface, while the shaft 3 can be used as an alignment axis for approach to the ball and hole. The angular cant of the shaft relative to the yoke bight or cross bar 4 enables a greater moment to be applied to the shaft with less force, assuring greater accuracy of the stroke.

I claim:

1. A pendulum-type golf putter comprising an elongated shaft;

a handle attached to the shaft including a U-shaped yoke having a pair of legs connected by a bight portion, and a rotatable mandrel between the legs of said yoke substantially parallel to the bight of said yoke.

2. The putter of claim 1 wherein said mandrel includes a cylindrical grip mounted on and oppositely extending conical pivot pins extending from said legs of said yoke.

3. The putter of claim 1 wherein said golf club shaft is mounted and connected at an angle to the bight of said yoke.

4. The putter of claim 1 including an adapter fixed to the bight of said yoke at an angle, said shaft being mounted on said adapter.

5. The putter of claim 4 wherein said mandrel includes a cylindrical grip mounted on and oppositely extending conical pivot pins extending from said legs of said yoke.

* * * * *